US006089703A

United States Patent [19]

Pearson

[11] Patent Number: 6,089,703

[45] Date of Patent: Jul. 18, 2000

[54] INK JET PRINTER AND METHOD OF PRINTING USING SAME

[75] Inventor: Anna Marie Pearson, Richmond, Ky.

[73] Assignee: Lexmark International, Inc., Lexington, Ky.

[21] Appl. No.: 09/179,623

[22] Filed: Oct. 27, 1998

[51] Int. Cl.[7] ..... B41J 2/01

[52] U.S. Cl. ..... 347/102

[58] Field of Search ..... 347/102, 104; 101/488; 219/216, 469, 470, 471; 399/307, 309, 390, 320

[56] References Cited

U.S. PATENT DOCUMENTS

| | | | |
|---|---|---|---|
| 640,923 | 1/1900 | Lam . | |
| 3,371,915 | 3/1968 | Kawamura et al. . | |
| 3,628,440 | 12/1971 | Czarnikow et al. . | |
| 4,106,868 | 8/1978 | Ophey . | |
| 4,277,524 | 7/1981 | Nakajima et al. . | |
| 4,290,353 | 9/1981 | Pav et al. . | |
| 4,607,947 | 8/1986 | Ensing et al. . | |
| 4,653,396 | 3/1987 | Wennerberg . | |
| 4,705,388 | 11/1987 | Huntjens et al. . | |
| 4,914,562 | 4/1990 | Abe et al. | 347/102 |
| 5,296,904 | 3/1994 | Jackson . | |
| 5,438,435 | 8/1995 | Lawniczak . | |
| 5,535,673 | 7/1996 | Bocko et al. . | |
| 5,771,054 | 6/1998 | Dudek et al. | 347/102 |

*Primary Examiner*—John Barlow
*Assistant Examiner*—MIcheal S Brooke
*Attorney, Agent, or Firm*—Todd T. Taylor, Esq.; D. Brent Lambert

[57] ABSTRACT

An ink jet printer for printing on a print medium includes a paper transport assembly with a plurality of rolls defining an approach path to a printing area and a return path from a printing area. A printhead positioned in the printing area is configured for jetting ink at selected locations on the print medium. A print medium heating assembly includes a heated roll, a first backup roll and a second backup roll. The heated roll and the first backup roll define a first nip therebetween and the heated roll and the second backup roll define a second nip therebetween. The first nip is positioned in association with the aproach path and the second nip is positioned in association with the return path.

6 Claims, 1 Drawing Sheet

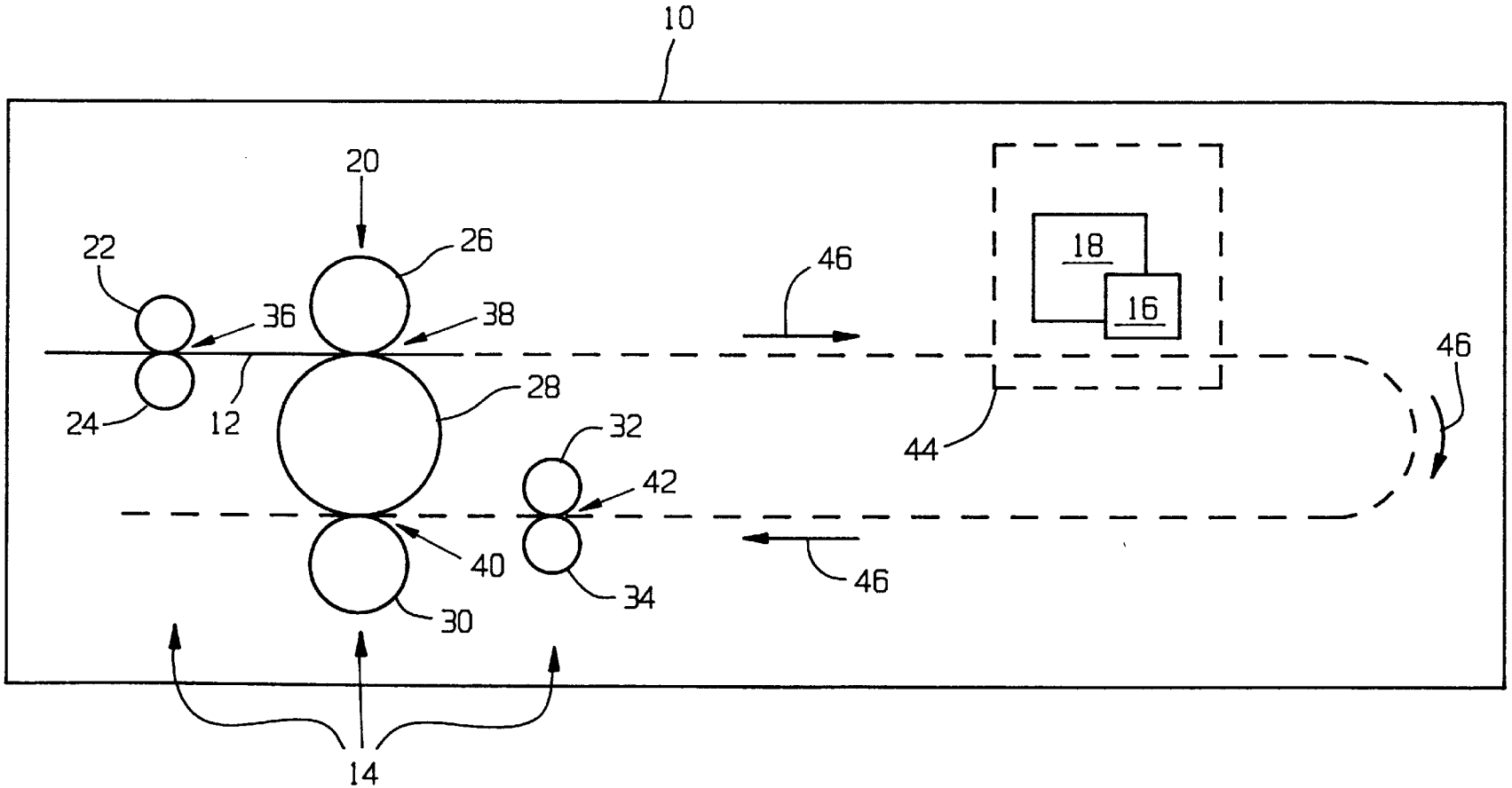
10
46
46
46
18
16
44
20
26
38
28
40
30
14
32
42
34
36
12
22
24

INK JET PRINTER AND METHOD OF PRINTING USING SAME

BACKGROUND OF THE INVENTION

1. Field of the Invention

The present invention relates to an ink jet printer, and, more particularly, to an ink jet printer which is configured to improve the print quality of a printed image on a print medium.

2. Description of the Related Art

An ink jet printer typically includes a printhead with a plurality of ink jetting orifices therein. At least one color ink is jetted through the orifices onto a print medium which is transported through a printing area adjacent to the printhead. Ink jet printers have an advantage of typically being less expensive than a laser printer. On the other hand, ink jet printers may have a disadvantage relative to laser printers in terms of a slower throughput rate of the print medium through the printer. For example, the throughput rate of an ink jet printer may be limited by the drying time associated with a particular ink which is jetted onto the print medium within the printer.

What is needed in the art is an ink jet printer which has a faster throughput rate and improved print quality.

SUMMARY OF THE INVENTION

The present invention provides an ink jet printer having a print medium heating assembly with a single source of heat which heats the print medium both before and after printing.

The invention comprises, in one form thereof, an ink jet printer for printing on a print medium, including a paper transport assembly with a plurality of rolls defining an approach path to a printing area and a return path from a printing area. A printhead positioned in the printing area is configured for jetting ink at selected locations on the print medium. A print medium heating assembly includes a heated roll, a first backup roll and a second backup roll. The heated roll and the first backup roll define a first nip therebetween and the heated roll and the second backup roll define a second nip therebetween. The first nip is positioned in association with the approach path and the second nip is positioned in association with the return path.

An advantage of the present invention is that the print medium is heated both before and after printing to improve the quality of the print image.

Another advantage is that the print medium is heated both before and after printing using a single print medium heating assembly.

Yet another advantage is that a single source of heat is used for both heating steps.

A further advantage is that the single source of heat may be easily and inexpensively provided using a single heated roll.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic illustration of one embodiment of an ink jet printer of the present invention. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown an embodiment of an ink jet printer 10 of the present invention for printing on a print medium 12, with which the ink jet printing method of the present invention may be carried out.

Ink jet printer 10 generally includes a paper transport assembly 14, a printhead 16 carried by a movable carriage assembly 18 and a print medium heating assembly 20.

Paper transport assembly 14 defines a paper path within printer 10, through which print medium 12 is transported. More particularly, paper transport assembly 14 includes a plurality of rolls 22, 24, 26, 28, 30, 32 and 34. Rolls 22 and 24 define a nip 36 therebetween; rolls 26, 28 and 30 define respective nips 38 and 40 therebetween; and rolls 32 and 34 define a nip 42 therebetween. Print medium 12 is transported with paper transport assembly 14 through nips 36 and 38 in an approach path leading to a printing area 44, and is transported through nips 42 and 40 in a return path leading from printing area 44. The advance direction of print medium 12 along the approach path and return path indicated by dashed lines is represented by advance direction arrows 46.

Printhead 16 is configured for jetting at least one color ink onto print medium 12. Printhead 16 includes at least one array of ink jetting orifices (not shown) through which a corresponding color ink is jetted onto print medium 12. In the embodiment shown, printhead 16 is part of an ink jet cartridge assembly, which in turn is carried by movable carriage assembly 18 in transverse directions relative to the advance direction 46 of printhead 16. Printhead 16 is in the form of a mono-color printhead having a single array of ink jetting orifices for jetting a single color ink onto print medium 12; but may also be in the form of a multi-color printhead with a plurality of arrays of ink jetting orifices such as a cyan, magenta, yellow and black array of orifices for printing respective color inks onto print medium 12.

Print medium heating assembly 20 includes roll 28 which is disposed in association with each of rolls 26 and 30 to define respective nips 38 and 40, as described above. Roll 28 is a heated roll (such as through electrical resistance heating) which defines a single source of heat for heating print medium 12 both before and after print medium 12 is printed on. More particularly, heated roll 28 heats paper 12 as paper 12 is transported through the approach path associated with nip 38, and again heats print medium 12 as print medium 12 is transported through the return paper path associated with nip 40. Heating print medium 12 both before and after printing within printing area 44 using printhead 16 has been found to provide an improved print quality by providing a high optical density and good archival properties (water fastness and wet rub resistance). Moreover, heating print medium 12 both before and after printing within printing area 44 causes the ink jetted on print medium 12 to dry faster, thereby in turn effecting a faster throughput rate through printer 10.

In the embodiment shown, heated roll 28 is configured to have an exterior temperature of approximately 200 C. However, heater roll 28 may be configured to have a different peripheral temperature, dependent upon the particular ink(s) used during the printing process within printing area 44.

Moreover, in the embodiment of printer 10 shown in the drawing, printhead 16 is carried by movable carriage assembly 18 in directions transverse to advance direction 46 of print medium 12. However, in another embodiment (not shown), printhead 16 may be configured in the form of a page-wide printhead which extends across the entire image area overlying print medium 12.

Additionally, in the embodiment of ink jet printer 10 shown in the drawing, print medium heating assembly 20 includes a single heated roll 28 which heats print medium 12 both before and after printing within printing area 44. However, in another embodiment (not shown), print medium heating assembly 20 may include a device for heating print medium 12 which is configured other than a heated roll 28. For example, print medium heating assembly 20 may include a single heating source in the form of an infrared heater which heats print medium 12 both before and after printing within printing area 44.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer for printing on a print medium, comprising:

a paper transport assembly including a plurality of rolls defining an approach path in which the print medium approaches a printing area and a return path in which the print medium departs from said printing area;

a printhead positioned in said printing area, said printhead configured for jetting ink at selected locations on the print medium;

a print medium heating assembly including a heated roll, a first backup roll and a second backup roll, said heated roll and said first backup roll defining a first nip therebetween and said heated roll and said second backup roll defining a second nip therebetween, said first nip positioned in association with said approach path and said second nip positioned in association with said return path; and a first paper transport roll and a second paper transport roll defining a third nip therebetween, said third nip positioned between said printhead and said second nip along said return path.

2. The ink jet printer of claim 1, further comprising a movable carriage assembly which carries said printhead and moves said printhead in a direction transverse to an advance direction of the print medium.

3. An ink jet printer for printing on a print medium, comprising:

a paper transport assembly including a plurality of rolls defining an approach path in which the print medium approaches a printing area and a return path in which the print medium departs from said printing area;

a printhead positioned in said printing area, said printhead configured for jetting ink at selected locations on the print medium;

a heated roll configured for heating the print medium in the approach path before printing with said printhead and heating the print medium in the return path after printing with said printhead;

a first backup roll, said heated roll and said first backup roll defining a first nip therebetween, said first nip positioned in association with said approach path; and a second backup roll, said heated roll and said second backup roll defining a second nip therebetween, said second nip positioned in association with said return path.

4. The ink jet printer of claim 3, wherein said heated roll is positioned remote from said printing area.

5. A method of printing on a print medium with an ink jet printer, comprising the sequential steps of:

providing a print medium heating assembly including a heated roll, a first backup roll and a second backup roll, said heated roll and said first backup roll defining a first nip therebetween and said heated roll and said second backup roll defining a second nip therebetween;

heating the print medium by transporting the print medium through said first nip to thereby bias the print medium against said heated roll;

printing on the print medium with a printhead; and heating the print medium by transporting the print medium through said second nip to thereby bias the print medium against said heated roll.

6. The method of claim 5, wherein said printing step occurs on a portion of the print medium that is unsupported by said heated roll.

* * * * *